US008529084B2

(12) United States Patent
Roehm

(10) Patent No.: US 8,529,084 B2
(45) Date of Patent: Sep. 10, 2013

(54) HAND-HELD POWER TOOL

(75) Inventor: Heiko Roehm, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 172 days.

(21) Appl. No.: 13/119,406

(22) PCT Filed: Aug. 12, 2009

(86) PCT No.: PCT/EP2009/060430

§ 371 (c)(1),
(2), (4) Date: May 23, 2011

(87) PCT Pub. No.: WO2010/034566

PCT Pub. Date: Apr. 1, 2010

(65) Prior Publication Data

US 2012/0106133 A1 May 3, 2012

(30) Foreign Application Priority Data

Sep. 29, 2008 (DE) ..... 10 2008 042 426

(51) Int. Cl.
*B25B 23/18* (2006.01)

(52) U.S. Cl.
USPC ..... 362/119

(58) Field of Classification Search
CPC ..... B25B 23/18
USPC ..... 362/119
See application file for complete search history.

(56) References Cited

U.S. PATENT DOCUMENTS

| | | | | |
|---|---|---|---|---|
| 7,109,450 | B2 * | 9/2006 | Kaji et al. | 219/620 |
| 7,185,998 | B2 | 3/2007 | Oomori | |
| 2006/0262519 | A1 | 11/2006 | Hirschburger et al. | |
| 2007/0046110 | A1 * | 3/2007 | Liu | 310/50 |

FOREIGN PATENT DOCUMENTS

| | | |
|---|---|---|
| CN | 1425525 | 6/2003 |
| CN | 1700972 | 11/2005 |
| DE | 29719020 | 12/1997 |
| DE | 202005020216 | 3/2006 |
| TW | 287505 | 8/2005 |

OTHER PUBLICATIONS

International Search Report, PCT International Patent Application No. PCT/EP2009/060430, dated Nov. 20, 2009.

* cited by examiner

*Primary Examiner* — Diane Lee
*Assistant Examiner* — Sean Gramling
(74) *Attorney, Agent, or Firm* — Kenyon & Kenyon LLP

(57) ABSTRACT

A hand-held power tool is equipped with a lighting element for illuminating the working field, the lighting element including a light source and a trigger switch for activating or adjusting a drive motor forming a component of the lighting element in such a way that light beams emitted by the light source are guided via the trigger switch to the working field.

19 Claims, 2 Drawing Sheets

HAND-HELD POWER TOOL

FIELD OF THE INVENTION

The present invention relates to a hand-held power tool, in particular an electrically operated hand-held power tool such as a rechargeable screwdriver or rechargeable drill.

BACKGROUND INFORMATION

U.S. Pat. No. 7,185,998 B2 describes a rechargeable screwdriver or drill, which has an electric drive motor for driving a tool-holding fixture in a motor housing. Extending approximately perpendicularly to the motor housing is a grip housing, at the lower end of which a rechargeable battery pack for supplying power is situated. Situated in the area of transition between the rechargeable battery pack and the grip housing is a lighting element, which includes a light source having a lens placed in front of it, through which a light beam is emitted to the working field lying directly in front of the tool-holding fixture. Because of the comparatively large distance between the lighting element and the working field, the lighting element must have relatively high light intensity.

According to an alternative embodiment described in U.S. Pat. No. 7,185,998 B2, the lighting element is located in the front area of the motor housing, in the immediate proximity of the tool-holding fixture. A disadvantage here is the comparatively large construction height, which comes about due to the angular positioning of the lighting element relative to the tool axis. The trigger switch for activating the electric drive motor, positioned in the area of transition between the motor housing and the grip housing, cannot be operated in an optimal, ergonomic manner because of the lighting element being situated directly in front.

SUMMARY

An object of the present invention is to illuminate the working field of a hand-held power tool optimally without limiting ergonomics, using simple design measures.

An example hand-held power tool according to the present invention, which is in particular an electrically operated hand-held power tool such as a rechargeable screwdriver, a rechargeable combi drill, a rechargeable impact screwdriver or a rechargeable impact drill, has a switch assembly in a housing for activating or adjusting a drive motor. The switch assembly is made up of a switch and a switch trigger. In addition, an illuminating element for illuminating the working field is provided, which includes a light source for generating a light beam in the direction of the working field. In accordance with the present invention, the trigger switch, which is movable relative to the housing, for activating or adjusting the drive motor also forms a component of the illuminating element, namely such that light beams emitted by the light source are guided to the working field by or via the trigger switch. The trigger switch accordingly has the further task, in addition to its original function of motor switch actuation, of guiding the light beam to the desired position.

This embodiment has various advantages. Since the trigger switch is a component of the illuminating element, the light source may be situated in the immediate proximity of the switch, so that it is no longer necessary to position the light source at a greater distance from the switch for ergonomic reasons. On the one hand, there are more design options for situating and positioning the light source in the housing. On the other hand, it is possible to design the light source to be small, since comparatively close positioning to the working field and thus the use of relatively low light intensities is possible. Moreover, the construction height of the light source is reduced, since it is possible to situate the light source at only a slight angle to the tool axis of the held-held power tool or parallel to the axis; the trigger switch, which is in the beam path of the light beam that is emitted by the light source, provides for distributing or reflecting the light beams in the direction of the working field to be illuminated.

According to one advantageous embodiment, the light source is situated outside the trigger switch in the housing, and the light beams of the light source are directed at the trigger switch, which has an optical forwarding function for the light beams that strike it. This may be implemented for example by the trigger switch being made at least partially of a transparent material, so that the light beams emitted by the light source pass through the switch in the direction of the working field to be illuminated. In this way a bundled light beam that strikes the switch may be focused in the manner of a lens, deflected, or possibly even fanned out, in order to achieve a desired illumination effect. Furthermore, it is also possible to let the light beam striking the switch reflect on the surface of the switch, for example by providing the switch with a mirror-coated surface or a polished surface which enables reflection. Finally, the geometry of the switch may also be prepared for a desired optical effect, for example in that the switch has a curved contour for bundling or scattering light; here the geometry of the switch may be designed appropriately, both in the case of a transparent material through which the light passes and in the case of a reflection on the surface. Furthermore, this embodiment is robust, since the light source within the switch is protected from soiling and damage.

According to another preferred embodiment, the light source is integrated into the interior of the trigger switch. This design is particularly space-saving, since no additional installation space needs to be reserved for the light source. Either an opening is made in the trigger switch for the emergence of the light beams that are emitted by the light source, or the wall of the trigger switch, designed as a hollow body, is made of a transparent material through which the light beams pass.

According to another preferred embodiment, the trigger switch, which is a component of the illuminating element, is a rotation-reversing trigger switch, using which the direction of rotation of the drive motor is set or reversed. The rotation-reversing trigger switch usually extends through the motor or gear housing of the hand-held power tool in a transverse direction, and projects beyond one of the two sides of the housing, depending on the currently set direction of rotation. The projecting part of the rotation-reversing trigger switch participates in the illumination of the working field. In another embodiment, on each side of the housing a light source is advantageously situated, which is activated, and it illuminates the projecting part of the rotation-reversing trigger switch when the rotation-reversing trigger switch is set accordingly.

In addition to situating the light source outside of the rotation-reversing trigger switch, however, another possibility is to integrate the light source into the interior of the rotation-reversing trigger switch, it being possible in this case to provide a light source in each lateral zone of the rotation-reversing trigger switch, which protrudes laterally when the corresponding side of the trigger switch projects over the side of the housing and thus becomes directly colinear with the working field to be illuminated. Also possible, however, is an embodiment having only a single light source fixed to the housing in the interior of the rotation-reversing trigger switch, the light emitted by the light source being guided via the currently projecting side of the rotation-reversing trigger switch in the direction of the working field.

Instead of or in addition to the rotation-reversing trigger switch, another trigger switch may also be a component of the illuminating element, for example the operating switch, by which the drive motor is put into operation and the rotational speed of the drive motor is adjusted. Another possibility is a power-on blocking button for the motor switch, or a power-on locking button for the motor current switch.

DETAILED DESCRIPTION OF EXAMPLE EMBODIMENTS

Figure 1:
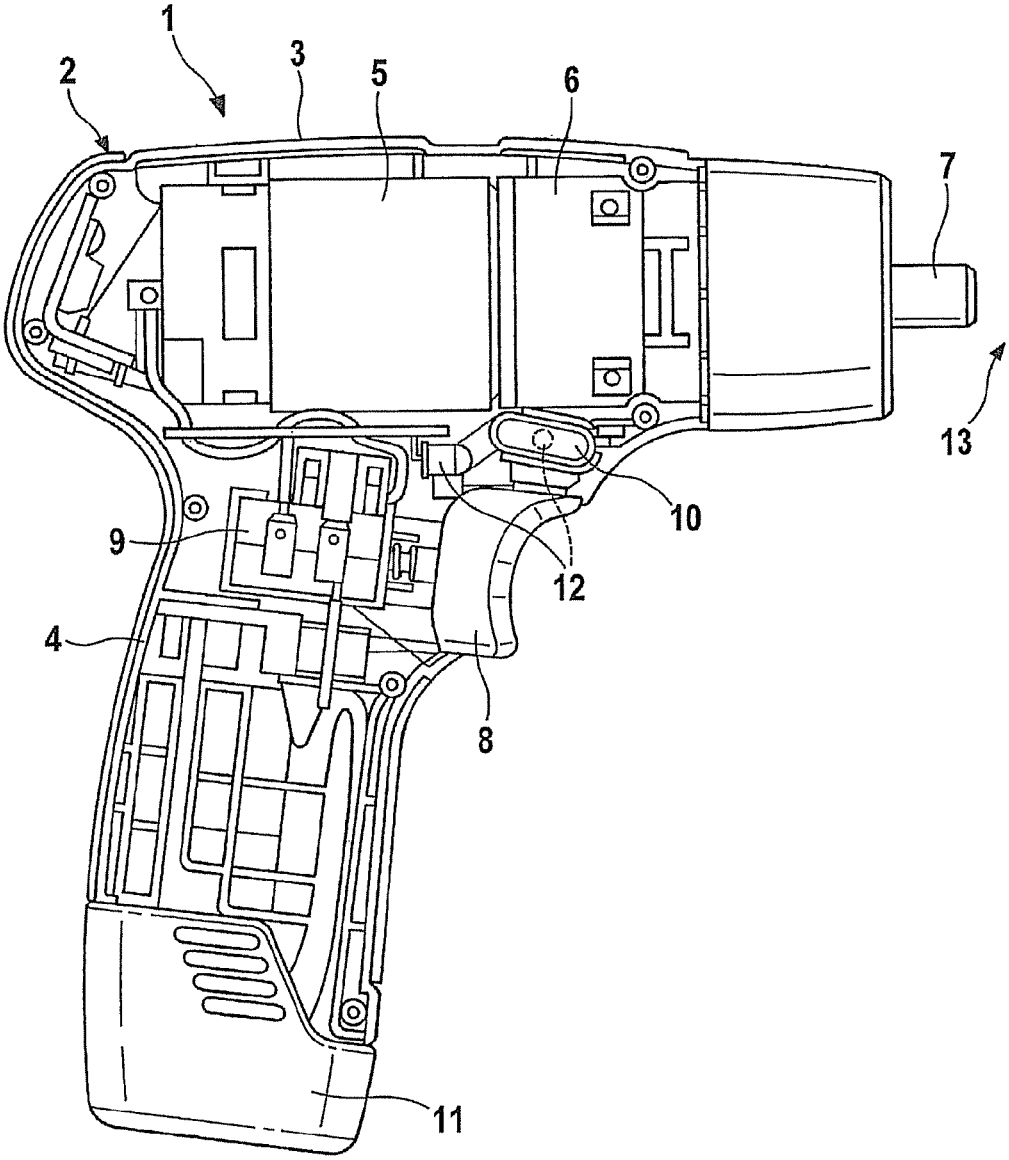
FIG. 1 shows a cross section through a hand-held power tool which is designed as a rechargeable drill or rechargeable screwdriver, an light source whose light beams strike the rotation-reversing trigger switch and are forwarded from there in the direction of the working field being situated adjacent to a rotation-reversing trigger switch.

In the figures, identical components are given identical reference numerals.

Hand-held power tool 1 shown in FIG. 1 has a housing 2, made up of a motor housing 3 and a grip housing 4 oriented approximately perpendicularly to motor housing 3, motor housing 3 and grip housing 4 possibly being designed as a single piece or as separate components. Contained in motor housing 3 is an electric drive motor 5 and also a gear unit 6, which is actuated by drive motor 5 and through which the drive motion is transferred to a spindle or tool-holding fixture 7 for receiving a tool. Gear unit 6 is, for example, a planetary transmission for converting the high motor speed to the lower speed of the tool-holding fixture.

Drive motor 5 is put into operation via a trigger switch 8, which is movable relative to the housing, and is located on grip housing 4, the speed of rotation of the drive motor being adjusted via the measure of actuation of trigger switch 8, which acts internally on a switch 9. In addition, a rotation-reversing trigger switch 10 which is movable relative to the housing is situated in the transition between motor housing 3 and grip housing 4 on the underside of the housing, which rotation-reversing trigger switch extends in a transverse direction transverse to the tool axis or motor axis and projects above one of the two sides of the housing, depending on the current setting. Using the rotation-reversing trigger switch, a rotation-reversing switch is activated, which sets the direction of rotation of the drive motor.

In the lower area of grip housing 4 there is a replaceable rechargeable battery pack 11, which serves to provide electric power to electric drive motor 5.

To illuminate working field 13, which is positioned in front of tool-holding fixture 7, a light source 12 is provided, which is situated in the area of the grip housing immediately below the motor housing, adjacent to rotation-reversing trigger switch 10. Light source 12 includes, for example, an incandescent bulb, an LED or OLED or an SMD-LED. Relative to working field 13, the light source 12 is located behind and at a distance from rotation-reversing trigger switch 10, which according to example embodiment of the present invention is a component of an illuminating element for illuminating working field 13. Accordingly, the illuminating element includes, in addition to light source 12, a rotation-reversing trigger switch 10, which guides the light beams which are emitted by light source 12 in the direction of working field 13. To this end, rotation-reversing trigger switch 10 is made, at least in its lateral areas projecting from the housing, of a transparent material such as PMMA, PC or PS. The light beams emitted by light source 12 are able to pass through the transparent wall of rotation-reversing trigger switch 10, while due to appropriate additional measures such as a corresponding curvature in the wall of the rotation-reversing trigger switch, a fanning effect or a bundling effect in the manner of a lens may be produced.

According to another embodiment, it is provided that the surface of rotation-reversing trigger switch 10 located within the housing reflects the incident light beams of light source 12. To this end, the surface of rotation-reversing trigger switch 10 is provided, for example partially or completely, in particular with a mirror-coating, or else is polished, in order to achieve in this way a reflection of the incident light beams.

In another embodiment, which is depicted in FIG. 1 with dashed lines, light source 12 is incorporated into the interior of rotation-reversing trigger switch 10, which is designed as a hollow body. This embodiment has the advantage of a particularly compact design. Possibilities in this case include both an embodiment having only a single light source 12 in rotation-reversing trigger switch 10 and an embodiment having at least two light sources, which are preferably situated in the lateral area of the rotation-reversing trigger switch. The wall of rotation-reversing trigger switch 10 is of transparent design also in this exemplary embodiment, so that the light beams produced by the light source are able to escape in the direction of working field 13. An additional possibility, however, is an escape aperture for the light beams in the wall of the rotation-reversing trigger switch.

Figure 2:
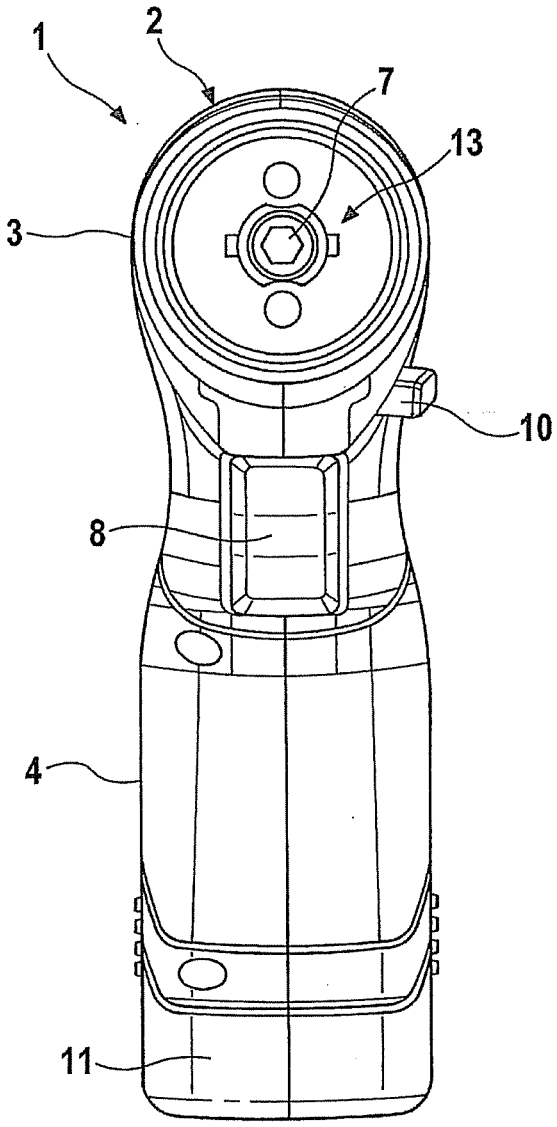
FIG. 2 shows the hand-held power tool in a front view.

As may be seen from the front view according to FIG. 2, rotation-reversing trigger switch 10 projects laterally over grip housing 4, so that a deflection of the light beams which is produced by the light source in the direction of working field 13 is possible from both positions of rotation-reversing trigger switch 10.

What is claimed is:

1. An electrically operated hand-held power tool comprising:

a housing;

a drive motor situated in the housing;

a first trigger switch for activating the drive motor;

a second trigger switch performing a power tool operation function different from the first trigger switch and movable relative to the housing; and an illuminating element for illuminating a working field of the power tool, the illuminating element including a light source;

wherein the second trigger switch forms a component of the illuminating element, such that light beams emitted by the light source are guided via the second trigger switch to the working field.

2. The hand-held power tool as recited in claim 1, wherein the power tool is one of a rechargeable screwdriver or rechargeable drill.

3. The hand-held power tool as recited in claim 1, wherein the light source is situated on the housing outside of the second trigger switch and the light beams of the light source are directed at the trigger switch.

4. The hand-held power tool as recited in claim 1, wherein the second trigger switch is made at least partially of a transparent material.

5. The hand-held power tool as recited in claim 1, wherein a surface of the second trigger switch is at least partially of reflective design.

6. The hand-held power tool as recited in claim 5, wherein the surface of the second trigger switch is at least partially polished.

7. The hand-held power tool as recited in claim 5, wherein the surface of the second trigger switch is at least partially mirror-coated.

8. The hand-held power tool as recited in claim 1, wherein the second trigger switch has a curved contour for one of bundling or scattering light.

9. The hand-held power tool as recited in claim 1, wherein the second trigger switch is movable relative to the housing.

10. The hand-held power tool as recited in claim 1, wherein the second trigger switch has light-emitting surfaces which are at a distance from actuating surfaces of the second trigger switch, which are configured to be actuated by an operator.

11. The hand-held power tool as recited in claim 1, wherein the light source is integrated into an interior of the second trigger switch.

12. The hand-held power tool as recited in claim 1, wherein the second trigger switch actuates a rotation-reversing switch.

13. The hand-held power tool as recited in claim 1, wherein the second trigger switch is a movable part of a power-on block.

14. The hand-held power tool as recited in claim 1, wherein the second trigger switch is a movable part of a power-on arrest.

15. The hand-held power tool as recited in claim 1, wherein the second trigger switch actuates a motor current switch.

16. The hand-held power tool as recited in claim 1, wherein the second trigger switch adjusts the drive motor differently from the first trigger switch.

17. The hand-held power tool as recited in claim 1, wherein the second trigger switch adjusts a rotational speed of the drive motor.

18. The hand-held power tool as recited in claim 1, wherein the second trigger switch provides a power-on blocking of drive motor operation.

19. The hand-held power tool as recited in claim 1, wherein the second trigger switch provides a power-on lock for continuous operation of the drive motor.

* * * * *

UNITED STATES PATENT AND TRADEMARK OFFICE

CERTIFICATE OF CORRECTION

PATENT NO. : 8,529,084 B2
APPLICATION NO. : 13/119406
DATED : September 10, 2013
INVENTOR(S) : Heiko Roehm It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 227 days.

Signed and Sealed this
Fifteenth Day of September, 2015

Michelle K. Lee

Michelle K. Lee
*Director of the United States Patent and Trademark Office*